United States Patent [19]

McKee

[11] 4,240,543

[45] Dec. 23, 1980

[54] DOCUMENT DISPLAY PIECE

[76] Inventor: Phyllis L. McKee, 4005 E. Campbell, Phoeniz, Ariz. 85018

[21] Appl. No.: 32,136

[22] Filed: Apr. 23, 1979

[51] Int. Cl.[3] ..... A45C 11/18; B65D 75/04; B65D 65/02; G09F 3/18

[52] U.S. Cl. ..... 206/39; 40/10 R; 150/39

[58] Field of Search ..... 206/39, 38; 40/10 D, 40/10 R; 150/39

[56] References Cited

U.S. PATENT DOCUMENTS

| | | | |
|---|---|---|---|
| 2,755,954 | 7/1956 | Antritter | 220/4 B |
| 3,553,865 | 1/1971 | Jones | 40/10 D |
| 3,829,995 | 8/1974 | Fakoury | 150/39 |
| 3,958,690 | 5/1976 | Gee, Jr. | 206/38 |
| 4,141,400 | 2/1979 | Mangan | 150/39 |

*Primary Examiner*—William T. Dixson, Jr.
*Attorney, Agent, or Firm*—Harry M. Weiss

[57] ABSTRACT

A document display piece comprises front and rear transparent plates joined at their lower ends to support a document inserted therebetween. Suspension means is formed integrally with the rear plate and extends upwardly therefrom. Thus, the display piece may be hung from any suitable support. The rear plate also contains a finger notch to facilitate document extraction.

6 Claims, 2 Drawing Figures

DOCUMENT DISPLAY PIECE

BACKGROUND OF THE INVENTION

1. Field of the Invention

This invention relates generally to a document container and, more particularly to an apparatus into which a document (e.g. photograph, printed matter, etc.) may be easily inserted and hung on any available protrusion or support.

2. Description of the Prior Art

Often a person preparing a meal will require the assistance of a recipe which is generally printed or written on paper or cards. It would be desirable to have a convenient means of positioning the recipe away from the working area which may be cluttered and where the recipe may become soiled or otherwide damaged, and yet still be within reading distance.

Various forms of document holders are known; however these generally require placement on a horizontal support surface and do not offer any protection of the document against damage.

SUMMARY OF THE INVENTION

It is an object of the present invention to provide an improved document holder.

It is a further object of the invention to provide a document display piece which may be conveniently hung from any available protrusion or support member.

It is a still further object of the invention to provide a document holder which fully protects the document while in use.

Finally, it is an object of the invention to provide a document holder which permits easy insertion and extraction of the document.

According to a broad aspect of the invention there is provided a document holder, comprising first and second substantially parallel plates at least one of which is transparent for receiving a document therebetween, said first and second plates being joined at a lower end thereof for supporting said document, and suspension means integral with an upper end of one of said first and second plates and extending therefrom for suspending said document and said first and second plates.

The above and other objects, features and advantages of the invention will be better understood from the following detailed description taken in conjunction with the accompanying drawings, in which:

DESCRIPTION OF THE PREFERRED EMBODIMENT

Figure 1:
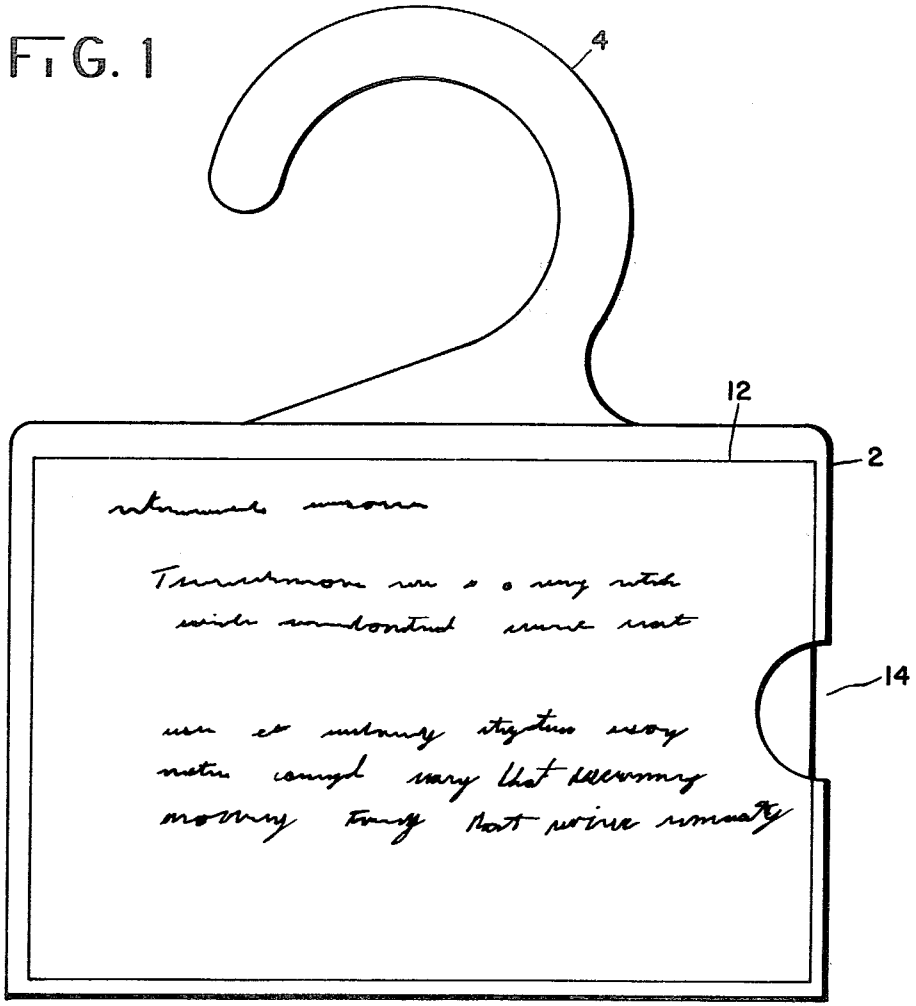
FIG. 1 is a front view of the inventive document holder.
Figure 2:
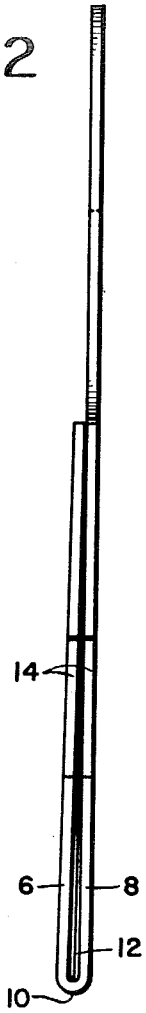
FIG. 2 is a side view of the document holder shown in FIG. 1.

The document holder shown in FIG. 1 comprises a frame portion shown generally at 2 and a suspension portion 4. Frame portion 2 comprises a front plate 6 and a rear plate 8 (FIG. 2). The front and rear plates are formed contiguously as is shown at 10 in FIG. 2 to provide a bottom support for a document 12 inserted between the front and rear plates. The front and rear plates are formed from a transparent material such as a clear plastic in order that the document or documents may be viewed therethrough. A finger notch 14 is provided in the rear plate to provide for easy insertion and removal of the document.

Suspension member 4 is formed either integrally with the front or rear plate (preferably the rear plate) or is fixedly coupled thereto. It has a rather wide sweeping curve so as to accommodate a large variety of structures and members, big and small, for the purpose of hanging the document holder. For example , it may be hung from a kitchen cabinet handle, a door knob, a simple carpenter's nail, etc. Typically, the inner curve 16 of the suspension member may have a radius of approximately one inch.

It should be clear that the frame portion 2 may be made in various sizes to accommodate different sizes and types of documents.

The above description of a preferred embodiment is given by way of example only, and changes in form and details may be made therein without departing from the spirit and scope of the invention as defined by the appended claims.

What is claimed is:

1. A document holder, comprising:

first and second substantially parallel plates at least one of which is transparent for receiving a rectangular document therebetween, said first and second plates being biased against each other, rigid and joined only at a lower end thereof for supporting said document, said first plate being a transparent front plate and said second plate being a rear plate; and suspension means comprising a hook formed integrally with an upper end of said rear plate and extending therefrom for suspending said document and said first and second plates.

2. A document holder according to claim 1 further including a notch in one of said first and second plates for facilitating document extraction.

3. A document holder according to claim 2 wherein said notch is in said rear plate.

4. A document holder according to claim 3 wherein both said first and second plates are transparent.

5. A document holder according to claim 4 wherein said first and second plates and said suspension means are formed from a single sheet of transparent material.

6. A document holder according to claim 5 wherein said transparent material is plastic.

* * * * *